US012534931B2

(12) United States Patent
Savard

(10) Patent No.: US 12,534,931 B2
(45) Date of Patent: Jan. 27, 2026

(54) TRANSPORTABLE AND DEPLOYABLE GARAGE

(71) Applicant: SAVAR-HANGAR Inc., Saint-Félicien (CA)

(72) Inventor: Philip Savard, Shipshaw (CA)

(73) Assignee: SAVAR-HANGAR INC., Saint-Félicien (CA)

( * ) Notice: Subject to any disclaimer, the term of this patent is extended or adjusted under 35 U.S.C. 154(b) by 279 days.

(21) Appl. No.: 18/546,767

(22) PCT Filed: Feb. 11, 2022

(86) PCT No.: PCT/CA2022/000003

§ 371 (c)(1),
(2) Date: Aug. 16, 2023

(87) PCT Pub. No.: WO2022/174327

PCT Pub. Date: Aug. 25, 2022

(65) Prior Publication Data

US 2024/0133200 A1 Apr. 25, 2024
US 2024/0229491 A9 Jul. 11, 2024

Related U.S. Application Data

(60) Provisional application No. 63/150,371, filed on Feb. 17, 2021.

(51) Int. Cl.
*E04H 6/04* (2006.01)

(52) U.S. Cl.
CPC ..... *E04H 6/04* (2013.01)

(58) Field of Classification Search
CPC .... E04H 6/04; E04H 6/06; E04H 6/08; E04H 6/02; E04H 6/025; E04H 6/005;
(Continued)

(56) References Cited

U.S. PATENT DOCUMENTS 2,817,344 A 12/1957 Teeter
3,231,305 A 1/1966 Beckman
(Continued)

FOREIGN PATENT DOCUMENTS

EP 22755426.8 12/2024
WO WO 2010137761 A1 12/2010
(Continued)

*Primary Examiner* — John D Walters
(74) *Attorney, Agent, or Firm* — Agence de Brevets Fournier

(57) ABSTRACT

A transportable garage is provided, for storing vehicles, aircrafts, equipment, or shelter individuals on a site. The garage comprises a frame assembly configurable between a collapsed configuration and an erected configuration. The frame assembly comprises support members extending along the ground when the garage is use; and a plurality of frame units connected to the support members. Each frame unit comprises a plurality of articulated frame members, which are configurable between a folded configuration and a deployed configuration. The garage may also include a covering assembly for covering the frame assembly when in the erected configuration. When the frame assembly is in the collapsed configuration, transportation of the garage to the site is facilitated.

34 Claims, 13 Drawing Sheets

(58) Field of Classification Search
CPC .. E04H 6/00; E04H 6/44; E04H 15/48; E04H 15/44; E04H 15/34; E04H 15/32; E04B 1/3205; E04B 1/32; E04B 1/34304; E04B 1/34363; E04B 1/34336; E04B 1/343
See application file for complete search history.

(56) References Cited

U.S. PATENT DOCUMENTS

| | | | | |
|---|---|---|---|---|
| 3,469,587 | A | 9/1969 | Folkes | |
| 3,469,588 | A * | 9/1969 | Rainwater | E04H 15/48 135/146 |
| 4,066,089 | A | 1/1978 | Rainwater | |
| 4,156,433 | A | 5/1979 | Beaulieu | |
| 4,347,690 | A | 9/1982 | Wallace, Jr. | |
| 5,107,639 | A | 4/1992 | Morin et al. | |
| 5,746,237 | A | 5/1998 | Arnic | |
| 6,223,479 | B1 | 5/2001 | Stockli | |
| 6,434,895 | B1 | 8/2002 | Hosterman et al. | |
| 7,584,763 | B2 | 9/2009 | Yoon | |
| 8,820,340 | B2 * | 9/2014 | Hughes | E04H 15/48 135/145 |
| 9,410,343 | B2 | 8/2016 | Hotes | |
| 9,834,954 | B2 * | 12/2017 | Becher | E04H 15/405 |
| 2011/0284044 | A1 | 11/2011 | Baldussi | |
| 2012/0017961 | A1 | 1/2012 | Hughes | |
| 2014/0311051 | A1 | 10/2014 | Fagan | |

FOREIGN PATENT DOCUMENTS

| | | |
|---|---|---|
| WO | WO PCT/CA2022/000003 | 5/2022 |
| ZA | 200 800 570 B | 12/2008 |

* cited by examiner

TRANSPORTABLE AND DEPLOYABLE GARAGE

FOREIGN PRIORITY CLAIM

This is a 35 U.S.C. § 371 application of, and claims priority to, International Application No. PCT/CA2022/000003, which was filed on Feb. 11, 2022, and published as Publication No. WO 2022/174327, which claims priority to US Provisional Patent Application No. U.S. 63/150,371, which was filed on Feb. 17, 2021, the entirety of all these applications are incorporated herein by reference.

FIELD

The invention generally relates to garages, shelters or storage buildings, and more particularly relates to a garage that can be deployed or collapsed for easy installation and transportation.

BACKGROUND

On far-off sites, such as construction sites or military bases, there is often a need for large garages or shelters to store several vehicles, large equipment, motorized or not, or even troops.

Temporary garages are often built for the time of the mandate, and stripped down when the mandate ends, the garage materials being simply thrown away. The construction of temporary garages and storage buildings entails transporting the necessary material on site, building the garage, insulating the walls and roof if needed, and putting the garage down when no longer needed, which require both resources and manpower. In most cases, the garage materials aren't reused, resulting in economic loss.

Another need for large garages or shelters is for storing small airplanes or helicopters. Erecting permanent buildings often require a construction permit, which may not be possible depending on local regulations. For a helicopter, one can imagine that placing it in the garage is a challenge.

While there exist small, collapsible garages for domestic use, their construction is not sturdy enough for commercial or military applications. Also, their deployment is often complex and difficult to mechanize. There is therefore a need for an improved transportable, collapsible garage for use such as those described above, as examples only.

SUMMARY

According to a first aspect, a transportable garage is provided, for storing vehicles, aircrafts, equipment or shelter individuals on a site. The garage comprises a frame assembly which is configurable between a collapsed configuration and a deployed configuration. The frame assembly comprises support members, which extend along the garage when it is in use. The garage also comprises a plurality of frame units connected to the support members. Each frame unit comprises a plurality of articulated frame members and is configurable between a folded configuration and a deployed configuration. The garage also comprises a covering assembly for covering the frame assembly when in the erected configuration. As can be appreciated, when the frame assembly is in the collapsed configuration, transportation of the garage to the site is facilitated.

In possible embodiments of the garage, the support members consist in two longitudinal support members, and the frame units are spaced apart and positioned along the support members.

In possible embodiments, the covering assembly comprises panels sized and configured to be inserted and secured between, or to, the frame units, to at least partially close off the transportable garage when in the erected configuration.

In another aspect, a method for erecting a transportable garage is provided. The method comprises a step of providing a frame assembly. The frame assembly comprises first and second support members, and a plurality of frame units connected to the first and second support members therebetween. Each frame unit comprises i) an articulated frame member, positioned in a folded configuration and that is configured to be movable in a deployed configuration, and having first and second lateral ends, and ii) first and second lateral frame members that are mounted to the articulated frame member at respective first and second lateral end thereof and to the first and second support member respectively. The method also comprises a step of distancing the first and second lateral support members, causing the articulated frame members to be moved in unison in the deployed configuration. The method can also comprise a step of covering the frame assembly.

According to an illustrative embodiment, there is provided a transportable garage frame comprising:

a plurality of frame units, each including an articulated frame member having first and second lateral ends and being movable between collapsed and deployed configurations;

first and second lateral frame members that are mounted to the articulated frame members at respective first and second lateral ends thereof; and at least one pair of first and second lateral support members for fixedly receiving the plurality of frame units therebetween, respectively by their first and second lateral frame members;

whereby, moving the first and second lateral support members in close proximity causes the articulated frame members to be moved in unison in the collapsed configuration, and distancing the first and second lateral support members causes the articulated frame members to be moved in unison in the deployed configuration.

According to a more specific illustrative embodiment, there is provided a transportable garage comprising the transportable garage frame and a covering assembly for covering the transportable garage frame.

According to another more specific illustrative embodiment, there is provided a transportable garage comprising:

a plurality of frame units, each including an articulated frame member having first and second lateral ends and being movable between collapsed and deployed configurations; the articulated frame member including first and second lateral V-shaped frame members, each pivotably connected to a respective one of the first and second lateral frame members; at least one of the plurality of frame units including an actuating system for moving the plurality of frame units between the collapsed and deployed configurations; the actuating system including first actuating mechanisms operatively coupled between each of the first and second lateral V-shaped frame members and the respective one of the first and second lateral frame members, and a second actuating mechanism between each two adjacent V-shaped frame members; the first and second actuating mechanisms being operable in unison to move the articulated frame member between the collapsed and deployed configurations;

first and second lateral frame members that are mounted to the articulated frame members at respective first and second lateral ends thereof;

at least one pair of first and second lateral support members for fixedly receiving the plurality of frame units therebetween, respectively by their first and second lateral frame members; and a plurality of covering panels sized and configured to be secured to the plurality of frame units so as to extend therebetween.

According to another illustrative embodiment, there is provided a frame unit for use in the frame structure of deployable garages, buildings or shelters, the frame units comprising:

an articulated frame member having first and second lateral ends and being movable between collapsed and deployed configurations; and first and second lateral frame members that are mounted to the articulated frame members at respective first and second lateral ends thereof.

The expression garage should be construed broadly in the description and in the claims as including any generally closed building that is intended to house vehicles and equipment, or used for military or humanitarian applications, as examples only.

Other objects, advantages, and features of the transportable garage frame, transportable garage formed therewith and method for erecting a garage and frame will become more apparent upon reading the following non-restrictive description of illustrative embodiments thereof, given by way of example only with reference to the accompanying drawings.

DETAILED DESCRIPTION

Figure 1:
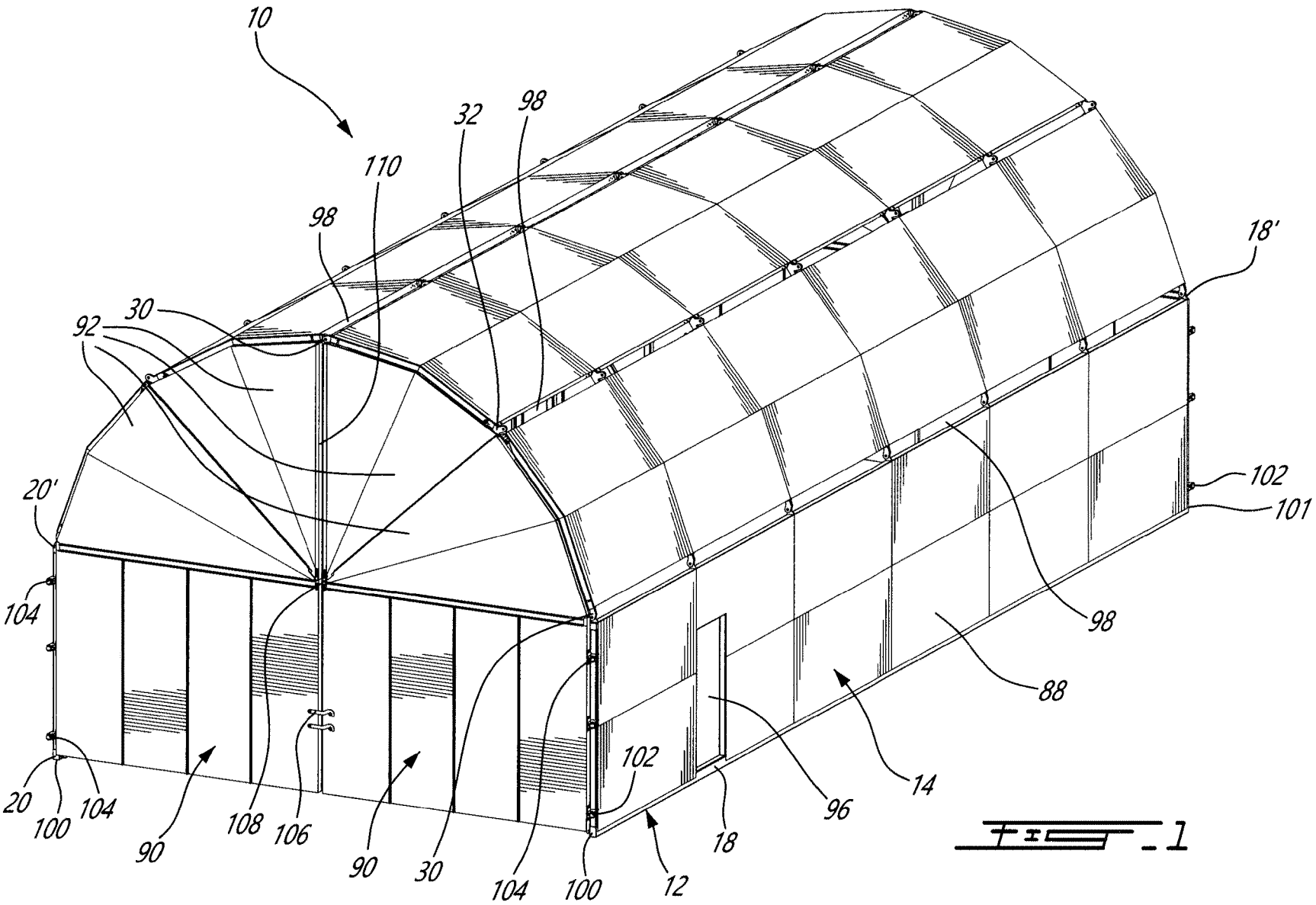
FIG. 1 is a perspective view of a transportable garage, shown in a deployed state, with a covering assembly made of panels, according to a first illustrative embodiment.
Figure 2:
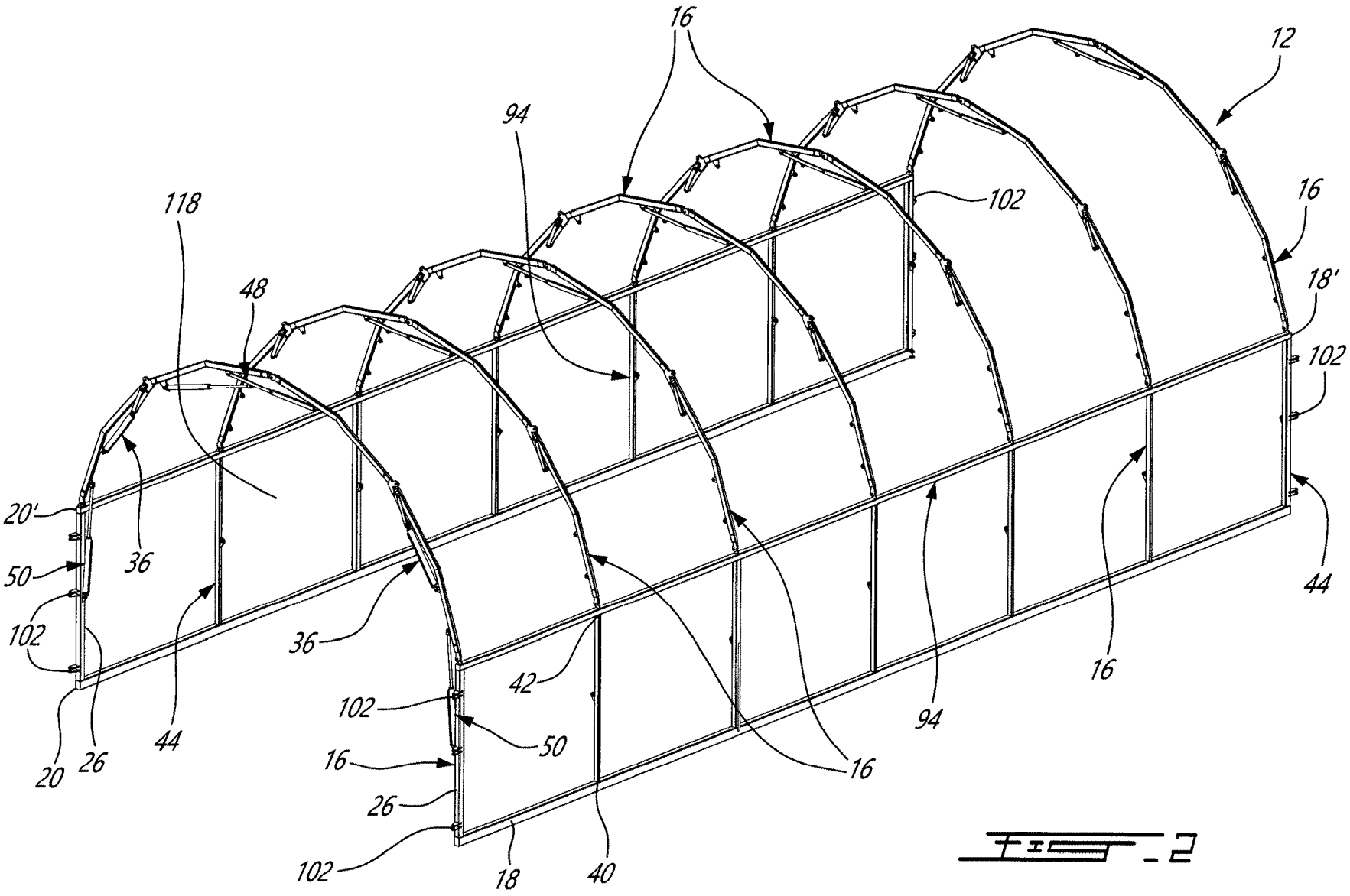
FIG. 2 is a perspective view of the frame assembly of the transportable garage of FIG. 1, in an erected configuration, showing the plurality of frame units.

It should be understood that the elements of the drawings are not necessarily depicted to scale, since emphasis is placed upon clearly illustrating the elements and structures of the present embodiments.

In the following description, similar features in the drawings have been given similar reference numerals, and in order not to weigh down the figures, some elements are not referred to in some figures if they were already identified in a precedent figure. Herein, it shall further be noted that, for avoiding unnecessary details obscuring the invention, only device structures and/or processing steps closely relevant to schemes according to the invention are shown in the accompanying drawings while omitting other details less relevant to the invention.

The embodiments, geometrical configurations, materials mentioned and/or dimensions shown in the figures are optional and are given for exemplification purposes only.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, un-recited elements.

With references to FIGS. 1 to 10B, a transportable garage 10 according to a first illustrative embodiment will now be described.

The transportable garage 10 comprises a frame 12 and a covering assembly 14 supported by the frame 12

Figure 8:
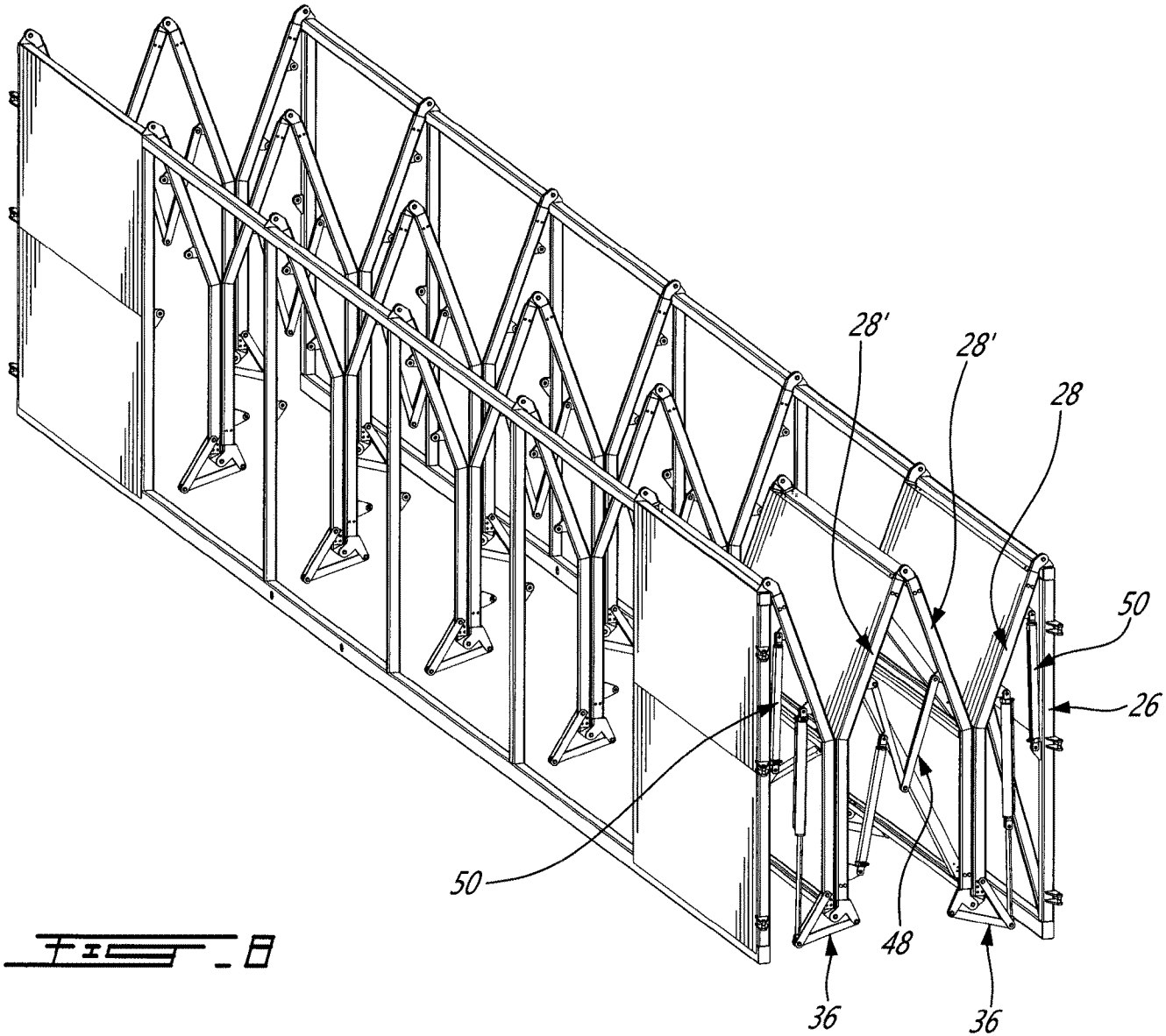
FIG. 8 is a perspective view of the transportable garage of FIG. 6, in the collapsed configuration.

As illustrated in FIG. 1 the transportable garage 10 can be positioned in a deployed or erected configuration or, as illustrated in FIG. 8, in a collapsed configuration. By transportable garage, it is meant that the garage 10 can be transported, for example on the platform of a transport truck, in its collapsed configuration, to bring it to an installation site. The garage 10 does not need to be completely dissembled for transportation and can be reused for different applications. As will be described hereinbelow in more detail with reference to a second illustrative embodiment, the garage may also be provided with traction elements, such that it can be towed or such that it can be controllably moved.

The garage 10 can be sized and dimensioned to store vehicles, including, without limitations, haul trucks, excavators, dump trucks, bulldozers, and the likes. It can be used to store different types of military vehicles and equipment, such as tanks and weapons. It can also be used to store airplanes and helicopters. If used as a shelter for people, the garage can include a foldable floor, as will be explained in more details below.

By "erected configuration", we refer to the garage 10 being in an expanded, deployed state, preferably having a semi-cylindrical or an arch shape, with the frame assembly 12 of the garage 10 being unfolded, stabilized and secured, for providing shelter for vehicles, materials or people. By "collapsed configuration", we refer to the garage being in a compact form, ready for storage or transportation, as shown in FIG. 8, wherein its frame assembly 12 is folded or collapsed.

The garage frame 12 includes a plurality of frame units 16 and two pairs of first and second lateral support members 18, 18' and 20, 20' that receive the plurality of frame units 16 therebetween.

Figure 4:
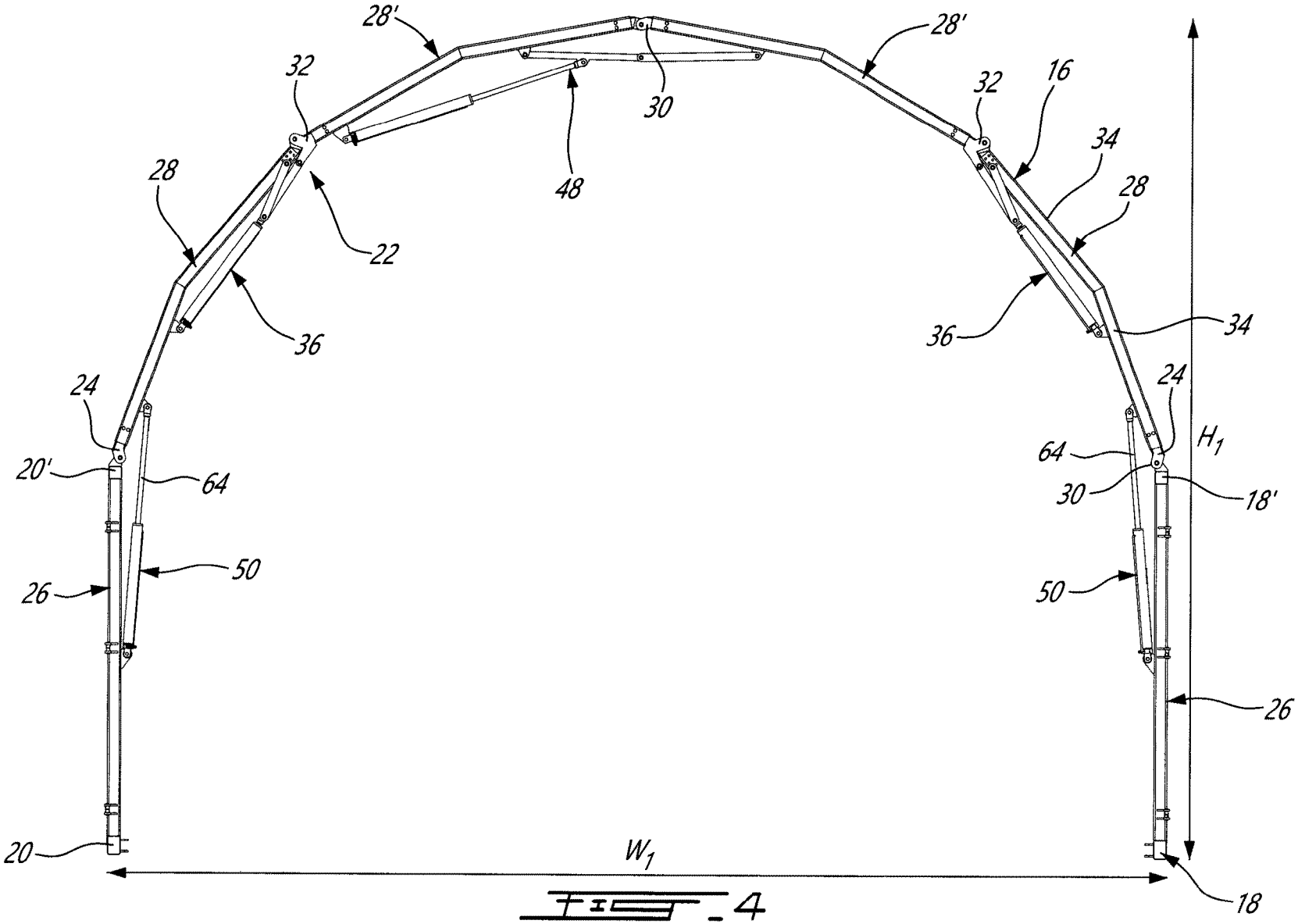
FIG. 4 is a front elevation view of a frame unit of the frame assembly, shown in a deployed configuration.
Figure 9:
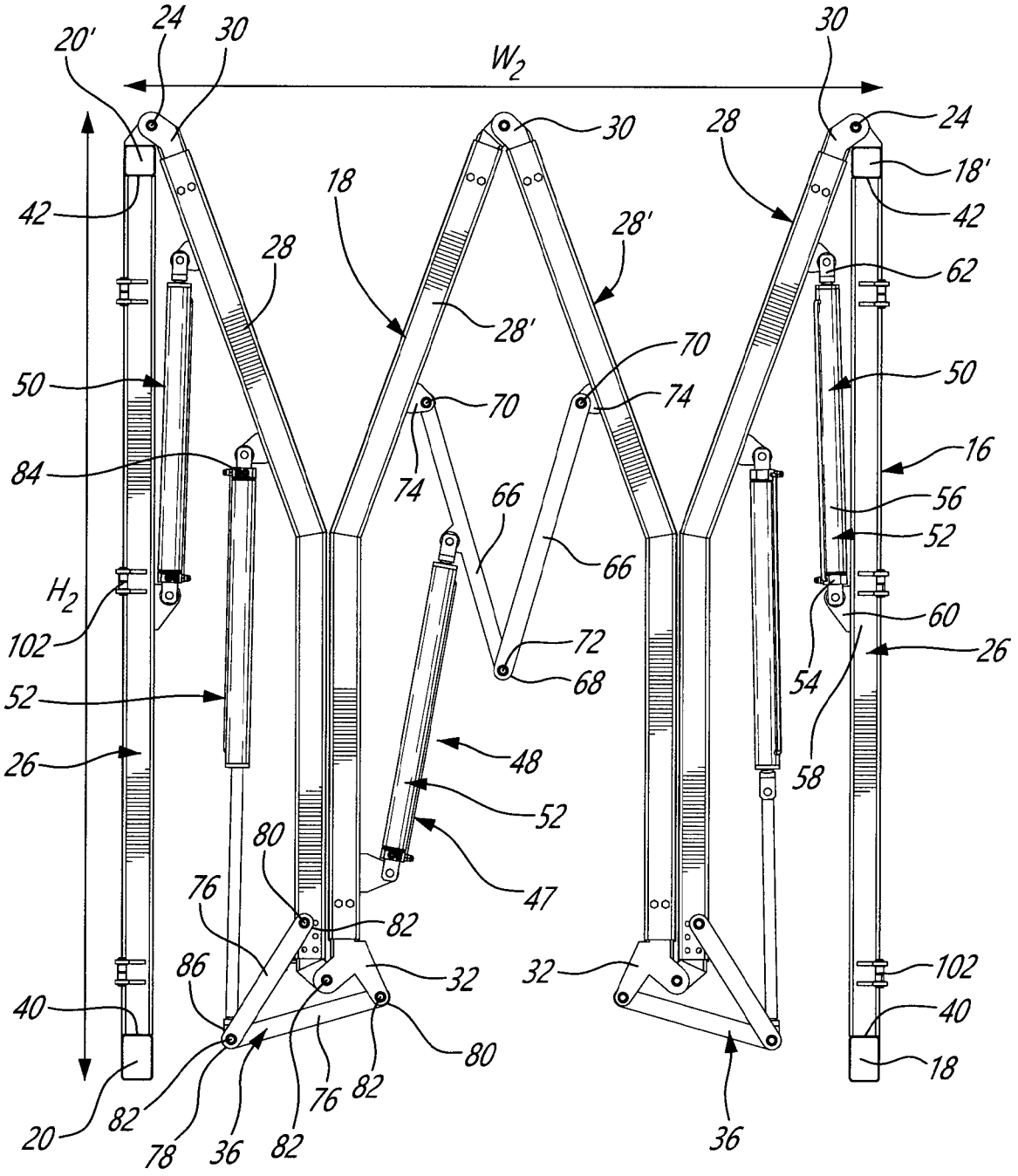
FIG. 9 is a front view illustrating a frame unit in a folded configuration.

With references more specifically to FIGS. 4 and 9, each frame unit 16 includes an articulated frame member 22 having first and second lateral ends 24 and being movable between collapsed and deployed configurations, and first and second lateral frame members 26 that are mounted to the articulated frame member 22 at respective first and second lateral end thereof 24 for relative pivot movement via pivot assemblies 30. The plurality of frame units 16 are secured to both pairs of first and second lateral support members 18, 18' and 20, 20' via their first and second lateral frame members 26.

Each articulated frame member 22 comprises four (4) flat V-shaped frame members 28 and 28' attached end-to-end by pivot assemblies 30 or 32 for relative pivot movement of two adjacent frame members 28, 28'. The articulated frame member 22 is configured to approximate a semi-circular frame assembly with the first and second lateral frame members 26 when in it is positioned in its deployed configuration, which is illustrated in FIG. 4.

The flat V-shaped frame members 28, 28' are each formed by two straight segments 34 that are joined to form an obtuse angle therebetween. According to another illustrative embodiment, some or all of the frame members 28 have another linear or non-linear configuration, such as including more than two segments or being in the form of a one or more bent segments (both not shown).

Also, while the articulated frame member 22 according to the first illustrative embodiment has four (4) segments, articulated frame member according to another illustrative embodiment (not shown) may have another number of segments.

Similarly, the first and second lateral frame members 26 are not limited to being straight or made of a single segment.

While the articulated frame units 16 are illustrated as extending within a single plane, they can alternatively be configured to extends within three (3) directions.

The V-shaped frame members 28 and 28' and the lateral frame members 26 are made from rectangular-profile steel tubes. According to another illustrative embodiment, the V-shaped frame members 28 and 28' and the lateral frame members 26 have another configuration and/or are made from another rigid material.

The pivot joint 30 between the articulated frame member 22 and each lateral frame members 26 is in the form of a convention pivot joint. Such a pivot joint 30 is also used between the two middle flat V-shaped frame members 28'.

Figure 5:
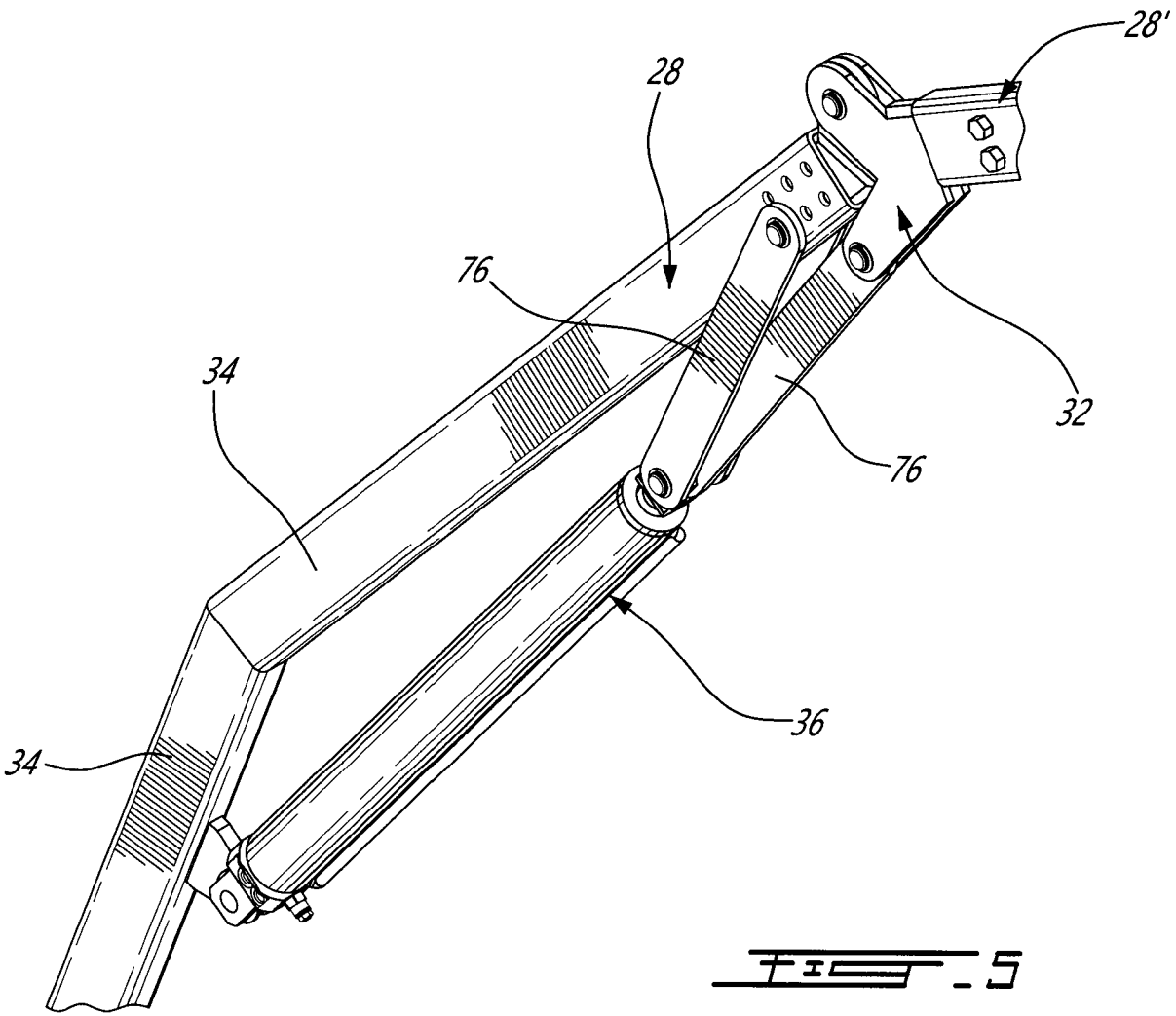
FIG. 5 is a close-up view of a section of a frame unit of FIG. 4, showing the connection between two frame members thereof, and an actuator therebetween.

With reference briefly to FIG. 5, the joint assembly 32 between each of the two middle flat V-shaped frame members 28' and a respective lateral flat V-shaped frame member 28 are in the form of a double pivot joint, which, in addition to such connection, allows further pivotably connecting an actuating mechanism 36 between members 28 and 28'.

The support members 18, 18' and 20, 20' are in the form of straight rectangular-profile steel 20 tubes that extend along the full length of the garage 10. According to another illustrative embodiment, the support members 18, 18' and 20, 20' have another configuration and/or are made from another rigid material.

A first pair of support members 18 and 20 are positioned parallel one another and fixedly receives the lower longitudinal ends 40 of a respective first and second lateral frame members 26 of the frame units 16 so that the frame units 16 are equally spaced transversally thereon, with a frame unit 16 mounted at each extremities of the support members 18 and 20. Being at the lower extremities of the frame units 16, the support members 18 and 20 are the parts of the garage that lays on the ground when installed at a site.

The second pair of support members 18' and 20' are positioned parallel one another and fixedly receives the higher longitudinal ends 42 of a respective first and second lateral frame members 26 of the frame units 16. Together, both support members 18 and 18' or 20 and 20' and first or second lateral frame members 16 define a rigid rectangular side frame 44 on each respective lateral side of the transportable garage 10. Also, a person skilled in the art will appreciate that, while the articulated frame members 22 are movable between a collapse configuration and an extended configuration, both rigid rectangular side frames 44 remain in their fixed configuration.

The support members 18, 18', 20 and 20' are not limited to being linear and extending horizontally along the ground. Also, according to another embodiment (not shown), at least one of the support members 18, 18', 20 and 20' is assembled from a plurality of members.

Also, according to yet another illustrative embodiment (not shown), a single pair of support members 18 and 20 or 18' and 20' are provided, which can also be positioned along the first and second lateral frame members 26 at other positions than illustrated. Indeed, a person skilled in the art will now appreciate that a single support member can be used on each lateral side of the plurality of frame units 16 to bring rigidity to the garage 10 and to allow moving the articulated frame members 18 between the collapse and extended configurations by the support member on each lateral side of the transportable garage 10 in close proximity.

According to yet another illustrative embodiment, a plurality of X-shaped trusses can be used between two adjacent frame units 16.

As can be seen for example in FIG. 9, the second pair of support members 18' and 20' are mounted on each respective lateral side of the garage 10 to both the articulated frame members 18 and to lateral frame member 16 therebetween. According to another embodiment (not shown), the support member 18' and 20' receives the lateral frame members 26 on their lateral sides, and the lateral frame members 26 are secured directly to the articulated frame member 18 via the pivot assembly 30.

Each frame unit 16 is further provided with an actuating system 47, including actuating mechanisms 36, 48, and 50 that operate in unison to move the articulate frame member 22 thereof between the collapse and extended configurations.

Each actuating mechanism 50 includes a hydraulic cylinder 52, that is mounted to a respective lateral frame member 26 and the V-shaped frame member 28 of the articulated frame member that is adjacent thereto, therebetween. More specifically, the cap end 54 of the barrel 56 of each cylinder 52 is pivotably mounted to the respective lateral frame member 26 near the longitudinal center 58 thereof, via a pivot mount 60. The distal end 62 of the piston rod 64 is pivotably mounted to the V-shaped frame member 28, near the outer lateral end 24 thereof.

The position of the actuating mechanism 50 is such that, when the hydraulic cylinder 52 is fully retracted (see FIGS. 8 and 9), the frame members 26 and 28 are folded over each other and define an acute angle therebetween, and when the hydraulic cylinder 52 is fully extended (see FIG. 4), the frame members 26 and 28 are unfolded and define an obtuse angle therebetween.

The actuating mechanism 48 is mounted to both inner flat V-shaped frame members 28' therebetween. More specifically, the mechanism 48 includes two arms 66 pivotably assembled by a first one 68 of their longitudinal ends 68-70 via a pivot pin 72, and pivotably mounted to a respective V-shaped frame member 28, at their other end 70 via a pivot joint 74. The pivot joint 74 is fixedly mounted near the middle of the portion of the V-shaped frame member 28' that is nearest the center of the articulated frame member 22.

The mechanism 48 further includes a hydraulic cylinder 52 that is pivotably mounted on one side to the portion of the V-shaped frame member 28' that is adjacent the frame member 28, and, on the other side to one of the two arms 66, in the middle thereof.

The configuration of the actuating mechanism 48 is such that, when the hydraulic cylinder 52 thereof is fully retracted (see FIGS. 8 and 9), the frame members 28' are folded onto each other and define an acute angle therebetween, and when the hydraulic cylinder 52 is fully extended (see FIG. 4), the frame members 28' are unfolded and define an obtuse angle therebetween.

The actuating mechanisms 36 are each mounted to a respective adjacent pair of frame members 28 and 28' therebetween. Each mechanism 36 includes two arms 76 pivotably assembled by a first one 78 of their longitudinal ends 78-80 via a pivot pin 82.

The other longitudinal end 80 of one of the two arms 76 is pivotably mounted to end of the frame member 28 closest to the frame member 28' via a pivot pin 82. The other longitudinal end 80 of the other arm 76 is pivotably mounted to the pivot assembly 32 via a pivot pin 82.

The actuating mechanism 36 also includes a hydraulic cylinder 52 that is pivotably mounted at one end 84 to the V-shaped frame member 28, on the same section thereof that receives the actuating mechanism 50, but nearer the center of the member 28. The cylinder 52 is pivotably mounted at its other end 86 to both arms 36 via the same pivot pin 82.

The configuration of the actuating mechanism 36 is such that, when the hydraulic cylinder 52 thereof is fully extended (see FIGS. 8 and 9), the frame members 28 and 28' are folded onto each other and define a reflex angle therebetween, and when the hydraulic cylinder 52 is fully retracted (see FIGS. 4 and 5), the frame members 28 and 28' are unfolded and define an obtuse angle therebetween.

The cylinders 52 are coupled to one or a plurality of hydraulic pumps using hoses, which have been omitted to alleviate the views. Also, in the Figures, most of the actuating systems 47 have been omitted to alleviate the views. However, according to the first illustrative embodiment, all the frame units 16 are equipped with an actuating system 47.

In operation of the actuating systems 47, the actuating mechanisms 36, 48 and 50 are operated simultaneously as described hereinabove to move each articulated frame member 22 between folded and deployed configurations shown respectively in FIGS. 8-9 and 4. It is to be noted that all systems 47 are operated simultaneously.

As best shown in FIG. 9, in the folded configuration, the segments of the inner and outer frame members 28 and 28' that are adjacent extends side by side. In other words, the angle between these segments is zero, so as to maximize compactness.

Figure 6:
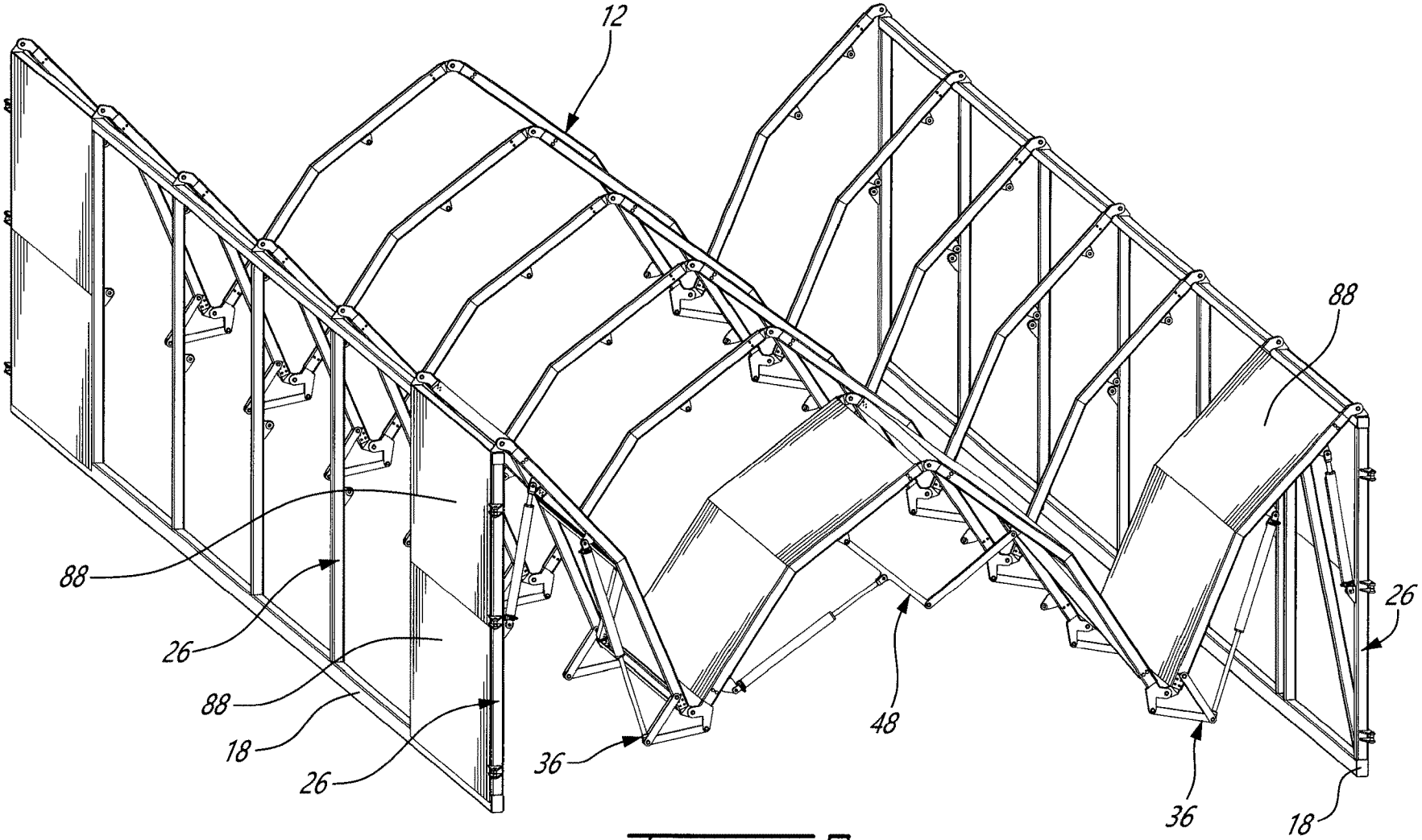
FIG. 6 is front perspective view of the transportable garage of FIG. 1, with the front, rear and some of the side panels removed, shown in between an erected and a collapsed configuration.
Figure 7:
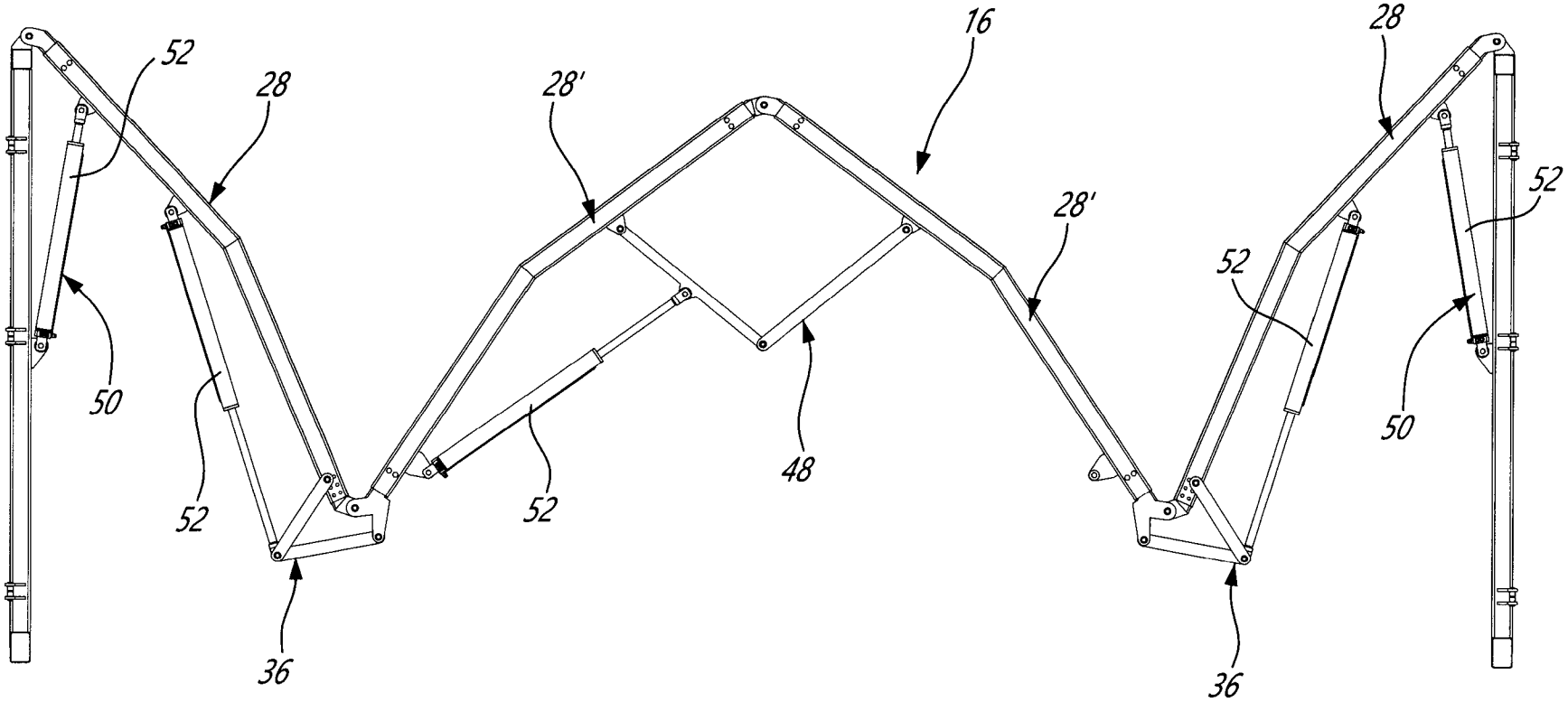
FIG. 7 is a front view of a frame unit of the transportable garage when configured as in FIG. 6.

FIGS. 6 and 7 illustrates an intermediary configuration of the transportable garage 10 between the folded and deployed configurations thereof. It is to be noted that the covering assembly 14 have also been partially omitted in these Figures to alleviate the views.

The actuating system 47 is adapted to the configuration of the frame unit 46 and may differ to the one illustrated. While the actuating mechanisms 36, 48 and 50 thereof have been illustrated as including hydraulic cylinders 52, other type of cylinders, other types of actuators, or any mechanism that when activated, applies a pulling or a pushing force in one or more direction can also be used.

According to still another embodiment (not shown), some or all of the actuating mechanism 47 are omitted.

With or without actuating mechanisms 47, a person skilled in the art will now appreciate that moving the first and second lateral support members 18, 18' and 20, 20' in close proximity causes all the articulated frame units 16 to be moved in unison in the collapsed configuration, and distancing the first and second lateral support members 18, 18' and 20, 20' causes the articulated frame units 16 to be moved in unison in the deployed configuration.

The frame members 26, 28 and 28' are typically made of rigid metal rods, such as steel, aluminum or composite materials. Wood or a polymeric material can also be considered in some applications.

The motion of the frame members 26, 28 and 28' is not limited to the previous description: alternative solutions may be possible, as long as an external force can pivot the different pairs/groups of frame members 26, 28 and 28', one relative to the other, from a folded to a deployed configuration.

The covering assembly 14 comprises peripheral wall panels 88, garage door panels 90 and triangular panels 92, sized and configured to be secured to the frame units 16 of the frame assembly 12, to close off the transportable garage when in the erected configuration.

The peripheral wall panels 88 are dimensioned to extend laterally along the full length of a segment 34 of the flat V-shaped frame members 28, 28' and has a width corresponding to half the length of the lateral frame members 26. The panels 88 also has a length corresponding to the distance between two adjacent frame units 16 along the support members 18, 18' 20, and 20'. The dimensions of the panels 88 therefor allows covering the full length and height of two lateral side sections 94 of the garage frame when mounted thereto side by side.

As can be seen in FIG. 1, some of the panels 88 can be cut to define a door opening 96 when mounted on the frame 12.

According to the first illustrative embodiment, the panels 88 are secured to the frame members 26, 28 and 28' using fasteners. According to another illustrative embodiment, the panels 88 are secured to the frame members 26, 28 and 28' using complementary attachments or brackets. They can also be welded thereon or attached using snap fit connections.

Figure 3:
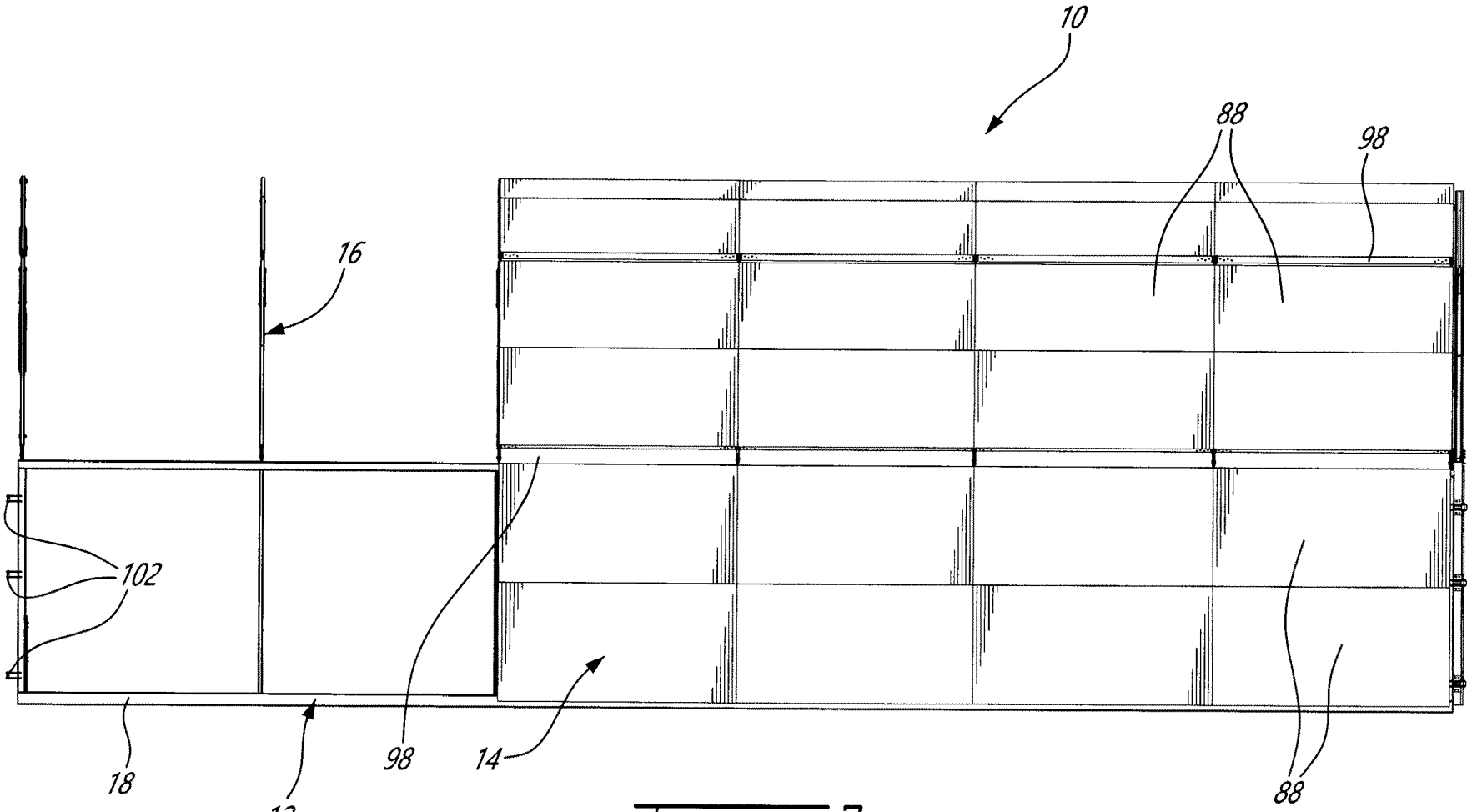
FIG. 3 is a side elevation view of the transportable garage of FIG. 1, with some of the covering panels removed.

As can be seen in FIGS. 1 and 3, the panels 88 are dimensioned so as to leave longitudinal gaps 98 that are registered with the pivot joints 30 and 32. This allows free movement for the frame units 16 when they are moved between the folded and deployed configurations. According to such an embodiment, the panels 88 can stay mounted to the garage frame 12 in both configurations.

According to such an embodiment, the panels 88 positioned adjacent to such gaps 98 can be provided with flexible flaps (not shown) secured along their corresponding longitudinal edge to cover the gap 98 and part of the adjacent panel 88. Other covering parts may also be mounted to the panels 88-92 to cover these or other gaps.

According to still another illustrative embodiment, the panels 88 are configured to leave no gap therebetween.

The garage door panels 90 are in the form of rectangular door panels that are each hingedly mounted to a respective first and second lateral frame members 26 of the frame unit 16 that are secured to the support members 18 and 20 at one longitudinal end 100 thereof. For that purpose, these frame members 26 and the door panels 90 are each provided with complementary pivot hinge members 102 and 104, and a door handle 106 is mounted therebetween.

The garage door panels 90 are pivotable about respective front lateral frame members 26 between a first position, wherein both panels 90 on each longitudinal end of the garage 10 are coplanar so as to close the bottom of the opening 118 defined by the corresponding frame unit 16, and a second position, wherein both panels 90 are folded onto the adjacent lateral side of the garage 10 (see FIG. 12), for example when the transportable garage 10 is in its collapsed configuration for transport.

Figure 12:
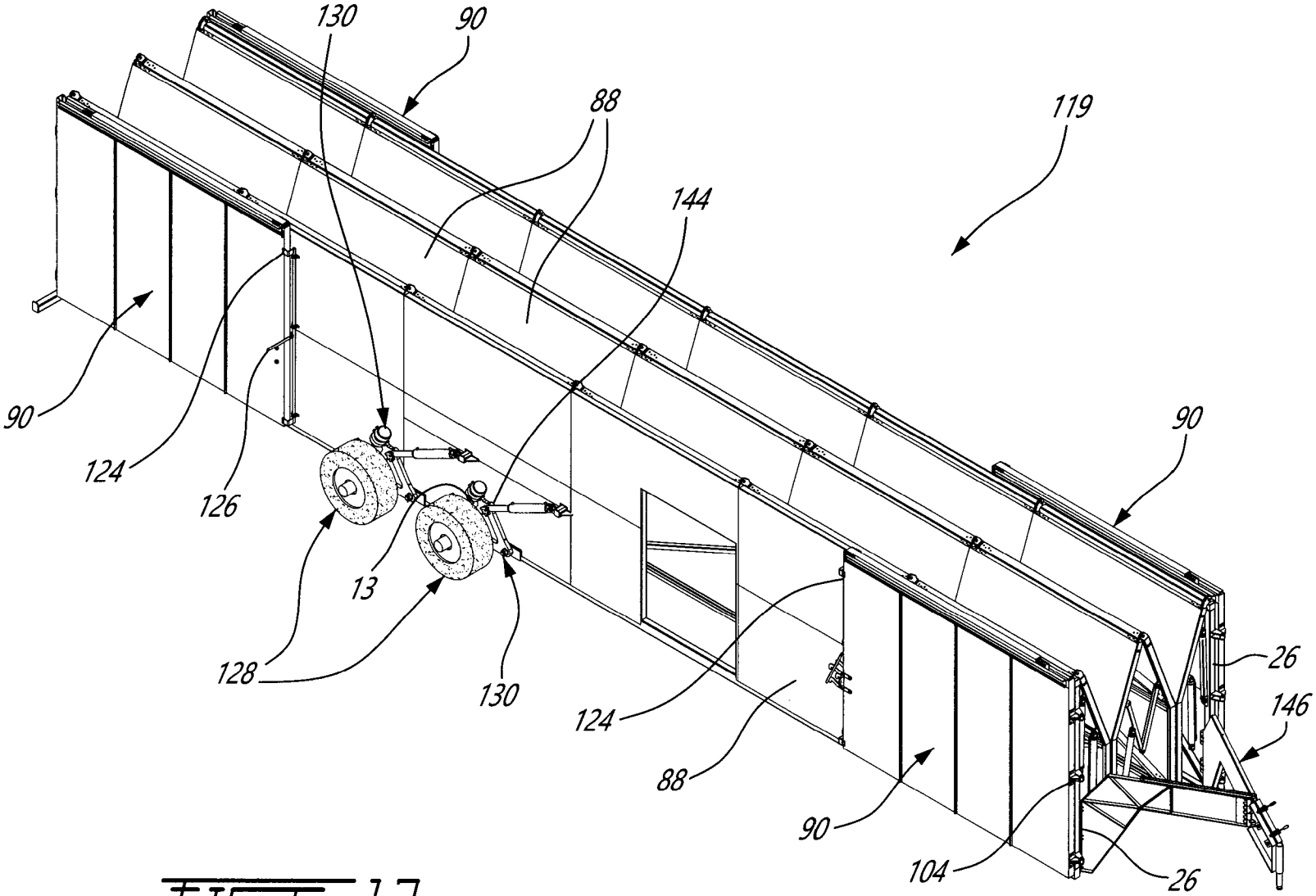
FIG. 12 is a perspective view of the transportable garage from FIG. 11, further comprising a hitch assembly.

As can also be seen in FIG. 12, further door panels 90 is similarly mounted at the other longitudinal end 101 of the garage frame 12.

According to another embodiment, the garage door panels 90 are pivotably mounted at one longitudinal side 100, 101 of the garage, and fixedly mounted at the other end 101, 100.

According to another illustrative embodiment, garage door panels 90 have another configuration than illustrated and/or are mounted to the frame unit 16 differently, such as without limitations slidably. According to such an embodiment, a crossbeam (not shown) is secured to the frame unit 16 above the doors 90 to slidably receive the panels 90.

The triangular panels 92 are mounted to the front frame unit 16 in a fan configuration using fasteners or other attachments, brackets. To facilite installing and uninstalling of the garage 10, triangular panels 220 can be shaped and configured to be rotated about a center point 108 located along an upright frame member 110 so that they can be nested in the garage door panels 90 or placed over the door panels 90.

It is to be noted that anyone or all of the panels 88-92 can be omitted.

According to the first illustrative embodiment, the material used for the covering panels 88-92 is aluminum. However, other types of material, for example steel, wood or plastic can also be used. Also, the panels 88, 90, and/or 92 can be insulated.

According to still another illustrative embodiment, the covering assembly 12 takes another form than the illustrated panels 88-92, such as any suitable material that can cover the frame structure/frame assembly 12, or one or several tarpaulins or plastic sheets.

Based on the above description, a possible method 200 for deploying the transportable garage 10 will now be described. The method 200 is summarized in FIG. 13.

Figure 13:
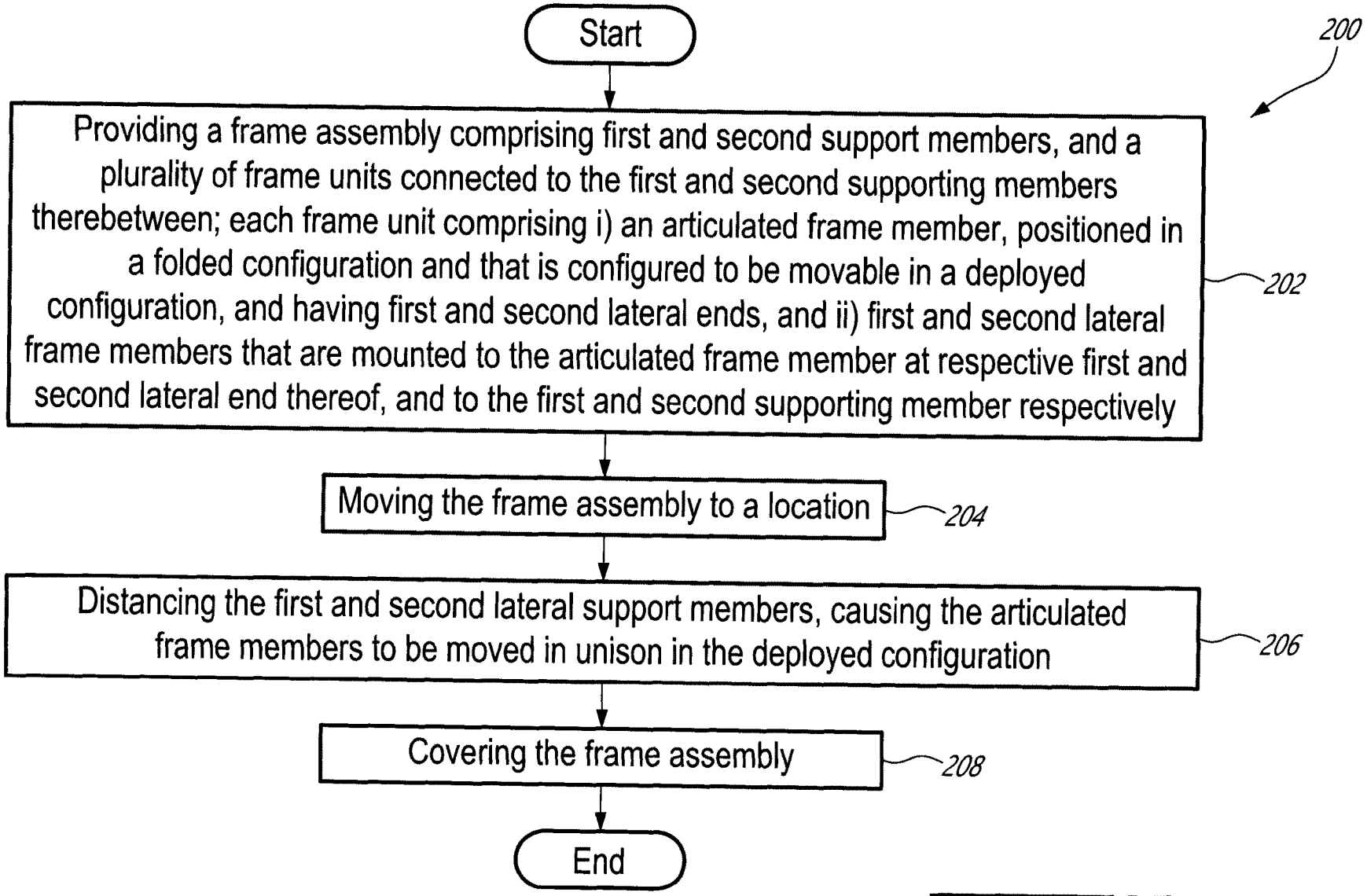
FIG. 13 is a flowchart of a method for erecting a transportable garage according to a first illustrative embodiment.

While in the folded configuration, the garage 10 is first transported from one location to another (step 204 in FIG. 13).

Then, the garage 10, while still in the folded configuration is positioned on a relatively stable surface, such as directly on the ground, for example. Once the garage is placed at the desired location, the distance between the first pair of support members 18-18' and the second pair of support members 20-20' is increased by controllably activating the actuating system 47 (see step 206 in FIG. 13).

As described hereinabove, the actuating system 47 can be omitted and, according to such an embodiment, the garage 10 is deployed manually.

Once the garage 10 is erected, if the covering panels 88, 90 and 92 have not yet been set in place, these panels are installed as described hereinabove (step 208 in FIG. 13).

The garage 10 can take various dimensions depending on the applications for which it is to be used. For example, the embodiments shown in the figures are about twenty-five (25) feet wide (about 7.6 meters), in the deployed configuration, and around height (8) feet wide (about 2.4 meters), in the collapsed configuration. The garage's height also increases when gradually being unfolded. In the collapsed configuration, the garage's height is about 10.5 feet (about 3.2 m), while in the deployed configuration, the height is about 22 feet (about 6.7 m).

With reference more specifically to FIGS. 4 and 9, W1 and H1 represent the width and height of the garage 10 in the deployed configuration, while W2 and H2 (identified in FIG. 9) represents the width and height of the garage in the collapsed configuration, where W2 and L2 are smaller than W1 and H1. When in the folded configuration, the height (H2) and width (H2) of the frame unit 16 is at least less than half of the height (H1) and width (H1) in the deployed configuration. According to the first illustrative embodiment, the ratio H2/H1 and W2/H1 is about one third, and the length of the garage 10 remains unchanged in the collapsed and deployed configurations. According to another illustrative embodiment (not shown), it can be considered to have the length reduced as well in different embodiments, by using telescopic or collapsible support members 18, 18' 20, and 20'.

Figure 10B:
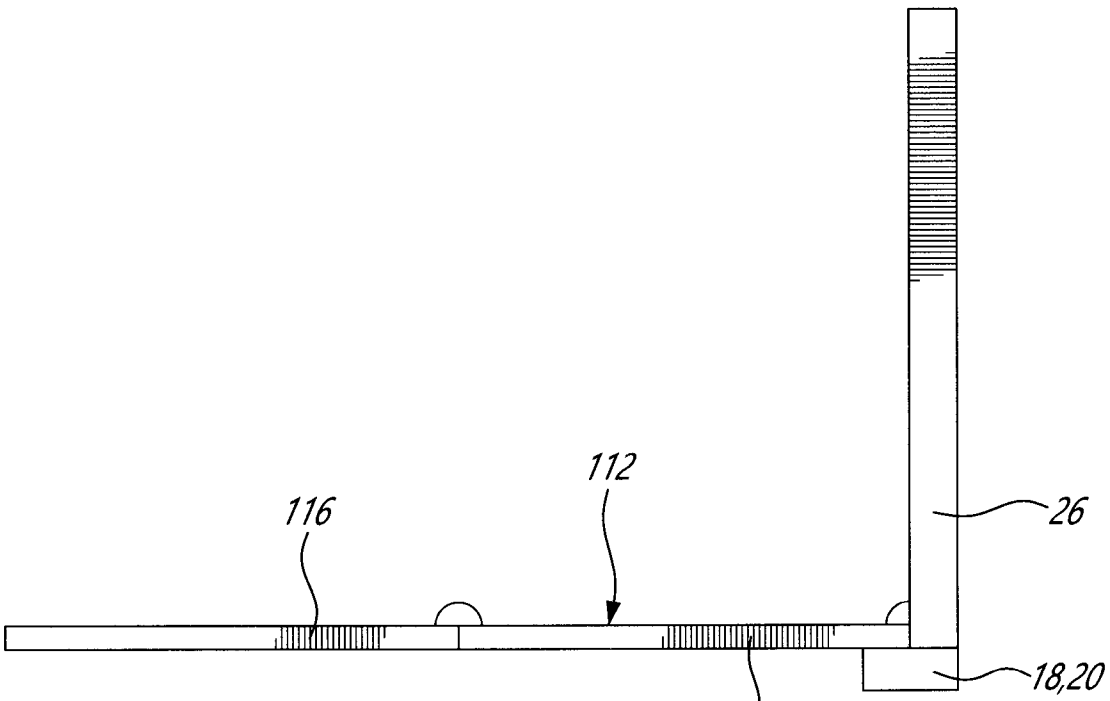
FIGS. 10A and 10B are side views of a portion of a lateral frame member and of a foldable floor panel, in folded and unfolded configurations respectively.
Figure 10A:
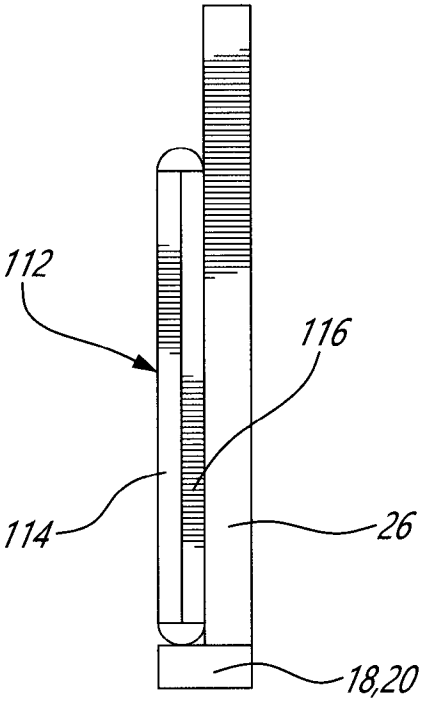

Referring to FIGS. 10A and 10B, according to a more specific illustrative embodiment, foldable floor panels 112 can be connected to the support members 18, 20 and/or to the lateral frame members 26 on each frame unit 16.

The floor panel 112 can be made of one or several sections 114-116. When made of several sections, the floor panels 112 can be folded and unfolded to facilitate their installation/uninstallation. For example, the outer end of the floor panels 112 can be pivotally connected to the support member 18, 20, such that, when folded, the floor panels 112 extend vertically along the upright members 26, as in FIG. 110A. Several sections could also be folded inwardly, one over the other.

When installing the garage 10, the floor panels 112 can be pivoted from their stored/vertical position (FIG. 10A) to a lowered/horizontal position (FIG. 10B), so as to extend along the ground. Like the cover panels 88-92, floor panels 112 can easily be removed if necessary. They can also be made of any type of rigid and flat material, such as wood, plastic, aluminum, etc.

Alternatively, it is possible to deploy the garage 10 over rigid plates if floor panels 112 are not needed. The use of floor panels 112 allow storing equipment more easily, as it provides a flat surface to move onto. It can also increase comfort of users, against moisture or dirt, if they need to spend time in the garage/shelter. When floor panels 112 are used, it is possible to include transverse frame members to the frame assembly 12, to support the foldable floor. Floor panels 112 can also be connected at mid-height to the lateral frame members 26, to create an intermediate floor or mezzanine. Such an intermediate floor can allow to maximize garage space and/or provide users with a distinct space, for example to sleep. If an intermediate floor is used, it is possible to reinforce it by further including upright members to the frame assembly, which will act as support beams.

Figure 11:
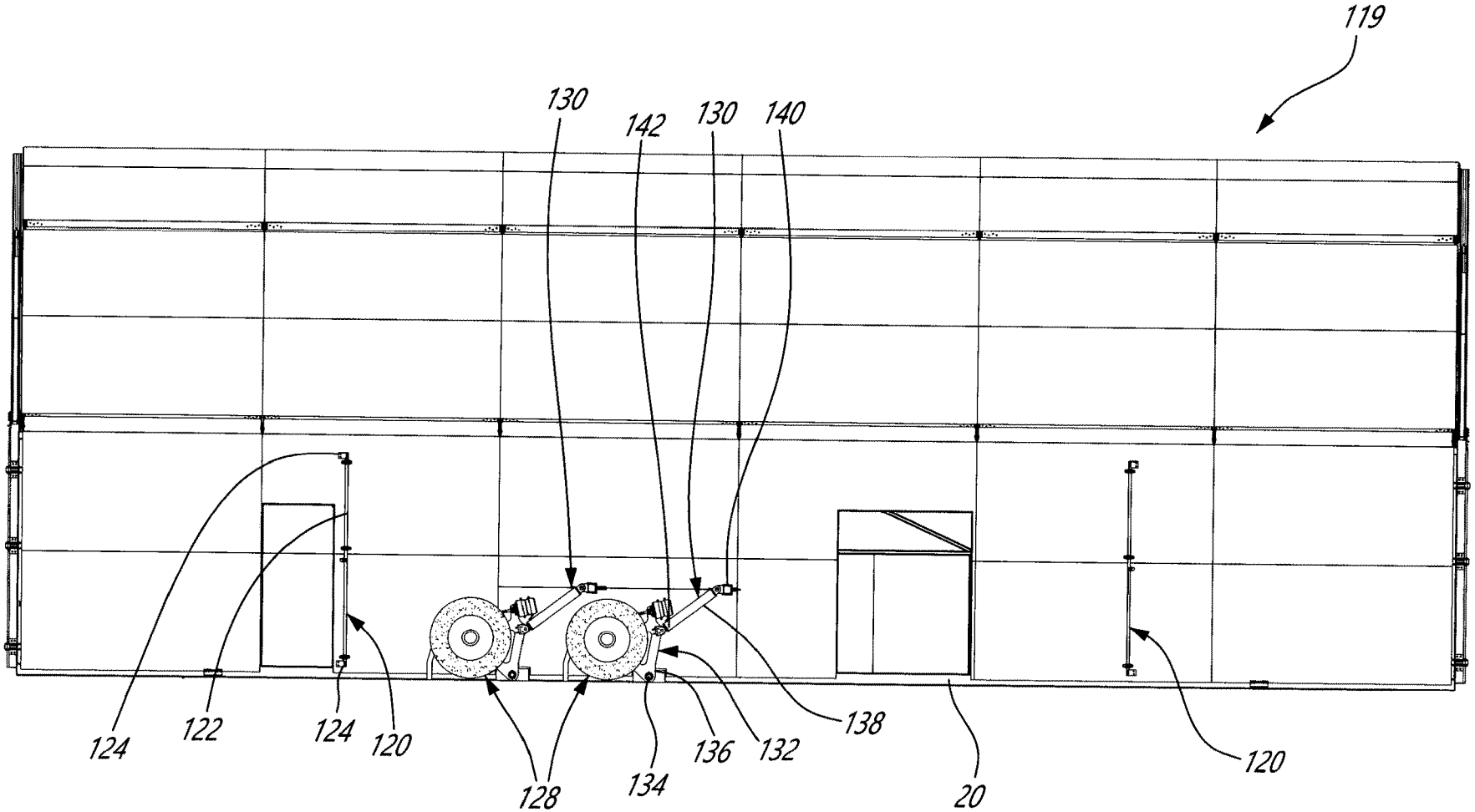
FIG. 11 is a side elevation view of a transportable garage according to a second illustrative embodiment.

A transportable garage 130 according to a second illustrative embodiment, will now be described with reference to FIGS. 11 and 12.

Since the transportable garage 119 is similar to the garage 10, only the differences therebetween will be described herein in more detail for concision purposes.

The transportable garage 119 further includes four (4) panel door securing systems 120 (only two shown) mounted to panels 88 on the lateral side of the garage 10. Each of these systems 120 allows preventing pivotal movements of a respective garage door panel 90 when the panel 90 is in its folded position. Each system 120 includes a rod 122 pivotably mounted to the panels 88, a couple of L-shaped plates 124 secured thereto, and a handle 126 for pivoting the rod 122 so as to move the plates 124 between an open and a latching position, where they prevent the corresponding garage door panel 90 from pivoting while in its folded position. A latching mechanism, associated with the rod 122 or handle 126, or fasteners provided between the panel 90 and plates 124, is further provided to selectively lock the position of the plates 124 in their latching position.

According to another embodiment (not shown), the garage door panel securing systems 120 take another form or are omitted.

The transportable garage 119 further comprises two pairs of carrying wheels 128 (only one pair shown), each pair mounted to the frame assembly 12 on a respective lateral side of the garage 119 via a wheel lifting mechanism 130.

The wheel lifting mechanism 130 includes a triangular wheel receiving frame 132 that is pivotably mounted to a respective support member 18 or 20 via a pivot joint 134 at a first corner 136 of the frame, and a hydraulic cylinder 138 that is pivotably mounted, at one of its longitudinal end 140, to an adjacent lateral frame member 26, and at the other one of its longitudinal end 142, to the triangular frame 132 at a second corner 144 thereof. The carrying wheel 128 is rotatably mounted to the triangular frame 132 at the third corner thereof.

In operation of the wheel lifting mechanism 130, the hydraulic cylinder 138 is controllably actuated to push or pull onto the triangular wheel receiving frame 132, which in turn causes the frame 138 to pivot about the joint 134, resulting in the wheel 138 being respectively lowered or raised relative to the support member 18 or 20.

While the wheels 128 are in their raised position, the transportable garage 119 lays on the ground and while in the lowered position, the wheels 138 act as carrying wheels, which allows the transportable garage to be trailed on a road by a semi-trailer (not shown) or any other suitable vehicle.

For that purpose, the transportable garage 119 further includes a trailer hitch assembly 146 that is removably attached to the frame unit 16 that is located at one of the two longitudinal ends of the support members 18 and 20. More specifically, the trailer hitch assembly 146 is secured to both lateral frame members 26 of the frame unit 16, therebetween.

Since a trailer hitch assembly is believed to be well-known in the art, it will not be described herein in more detail for concision purposes.

Even though the actuating mechanism 138 has been illustrated as being a hydraulic cylinder 138, other type of cylinders, other types of actuators, or any other mechanism can be used, that when activated, applies a pulling or a pushing force in one or more direction onto the triangular frame 132 can also be used.

The wheel receiving frame 132 is also not limited to being triangular and the frame can be of any configuration allowing actuating a pivotal movement to a wheel 128 mounted thereto by the hydraulic cylinder 138 or another actuator relative to the frame assembly 12.

According to still another illustrative embodiment, the wheel lifting mechanism 130 is omitted and the wheels 138 are directly mounted to the frame assembly 12.

According to yet another illustrative embodiment, the wheels 128 are replaced by other traction elements, such as skis, blades, or track assemblies.

While the transportable garage 119 is illustrated as having two pairs of carrying wheels 128, one on each lateral side thereof, the number of wheels 128 on each side may vary, depending on the size of the transportable garage 119 for example.

It is to be noted that many modifications could be made to the transportable garage 10 and 119 described hereinabove and illustrated in the appended drawings. For example:

- the number and disposition of the frame units 16 along the support members 18, 18' 20 and 20' may be different than illustrated;
- locking mechanism may be provided between members 18, 18' and 26 of the frame units 16 to prevent inadvertent movement thereof, especially, but not exclusively, in cases where the actuating systems 147 are omitted.

Although a transportable garage and an erecting method therefor have been described hereinabove by way of illustrated embodiments thereof, they can be modified. It is therefore to be understood that numerous modifications may be made to the illustrative embodiments and that the scope of the claims should not be limited by the preferred embodiment but should be given the broadest interpretation consistent with the description as a whole.

What is claimed is:

1. A transportable garage frame comprising:

a plurality of frame units, each including an articulated frame member having first and second lateral ends and being movable between collapsed and deployed configurations;

first and second lateral frame members that are mounted to the articulated frame members at respective first and second lateral ends thereof; and at least one pair of first and second lateral support members for fixedly receiving the plurality of frame units therebetween, respectively by their first and second lateral frame members;

whereby, moving the first and second lateral support members in close proximity causes the articulated frame members to be moved in unison in the collapsed configuration, and distancing the first and second lateral support members causes the articulated frame members to be moved in unison in the deployed configuration.

2. The transportable garage frame as recited in claim 1, wherein the first and second lateral frame members being mounted to the articulated frame members at respective first and second lateral ends thereof via pivot joints.

3. The transportable garage frame as recited in claim 2, wherein at least one of the articulated frame members includes at least two V-shaped frame members attached end-to-end by pivot joints for relative pivot movement of two adjacent V-shaped frame members.

4. The transportable garage frame as recited in claim 3, wherein the at least two V-shaped frame members include first and second lateral V-shaped frame members, each pivotably connected to a respective one of the first and second lateral frame members; at least one of the plurality of frame units including an actuating system for moving the plurality of frame units between the collapsed and deployed configurations; the actuating system including first actuating mechanisms operatively coupled between each of the first and second lateral V-shaped frame members and the respective one of the first and second lateral frame members, and a second actuating mechanism between each two adjacent V-shaped frame members; the first and second actuating mechanisms being operable in unison to move the articulated frame member between the collapsed and deployed configurations.

5. The transportable garage frame as recited in claim 4, wherein at least one of the first and second actuating mechanisms includes a linear actuator.

6. The transportable garage frame as recited in claim 5, wherein the linear actuator is in the form of a hydraulic cylinder.

7. The transportable garage frame as recited in claim 3, wherein the at least two V-shaped frame members include four V-shaped frame members, including first and second inner V-shaped frame members and first and second outer V-shaped frame members; each of the outer V-shaped frame members being pivotably mounted to a respective one of the first and second lateral frame members on a first lateral side and to a respective one of the two inner V-shaped frame members on a second lateral side.

8. The transportable garage frame as recited in claim 7, wherein each of the four V-shaped frame members are defined by first and second segments abutted to define an obtuse angle therebetween; wherein, while the articulated frame member is in its collapsed configuration:

the first segment of the first outer V-shaped frame member defines an acute angle with the first lateral frame member;

the second segment of the first outer V-shaped frame member and the first segment of the first inner V-shaped frame member are positioned back-to-back in a parallel relationship;

the second segment of the first inner V-shaped frame member defines an acute angle with the first segment of the second inner V-shaped frame member;

the second segment of the second inner V-shaped frame member and the first segment of the second outer V-shaped frame member are positioned back-to-back in a parallel relationship; and the second segment of the second outer V-shaped frame member defines an acute angle with the second lateral frame member.

9. The transportable garage frame as recited in claim 8, further comprising an actuating system including:

a) a first actuating mechanism between each of i) the first segment of the first outer V-shaped frame member and the first lateral frame member, and ii) the second segment of the second outer V-shaped frame member and the second lateral frame member;

b) a second actuating mechanism between each of iii) the first outer V-shaped frame member and the first inner V-shaped frame member, and iv) the second inner V-shaped frame member and the second outer V-shaped frame member; and c) a third actuating mechanism between the first and second inner V-shaped frame members.

10. The transportable garage frame as recited in claim 9, wherein each first actuating mechanism includes a first cylinder; each second actuating mechanism including first and second arms, each having first and second longitudinal ends and being pivotably assembled by their first longitudinal ends; the second longitudinal end of the first arm being pivotably mounted to a free end of a corresponding one of the second segment of the first outer V-shaped frame member or the first segment of the second outer V-shaped frame member; the second longitudinal end of the second arm being pivotably mounted to a free end of a corresponding one of the first segment of the first inner V-shaped frame member or the second segment of the second inner V-shaped frame member; the second actuating mechanism further including a second cylinder that is pivotably mounted on a first side thereof to a respective one of the first segment of the first outer V-shaped frame member or the second segment of the second outer V-shaped frame member, and pivotably on a second side thereof to the first longitudinal ends of the first and second arms; the third actuating mechanism including third and fourth arms, each having first and second longitudinal ends and being pivotably assembled by their first longitudinal ends, and pivotably mounted to a respective second and first segments of a respective first and second inner V-shaped frame member via a pivot joint, and a third cylinder that is pivotably mounted on one side to one of the third and fourth arms, and on the other side to one of the first segment of the first inner V-shaped frame member and the second segment of the second inner V-shaped frame member.

11. The transportable garage frame as recited in claim 8, wherein the articulated frame member is configured to approximate a semi-circular shape when in its deployed configuration.

12. The transportable garage frame as recited in claim 1, wherein articulated frame member is configured to approximate a semi-circular frame assembly with the first and second lateral frame members when the articulated frame member is positioned in its deployed configuration.

13. The transportable garage frame as recited in claim 1, wherein at least one of the plurality of frame units substantially extends within a single plane.

14. The transportable garage frame as recited in claim 1, wherein the at least one pair of first and second lateral support members extend along the full length of the transportable garage frame.

15. The transportable garage frame as recited in claim 1, wherein the at least one pair of first and second lateral support members includes first and second pairs of first and second lateral support members; wherein the first pair of first and second lateral support members are positioned near a longitudinal end of a respective one of the first and second lateral frame members, and the second pair of first and second lateral support members is longitudinally distanced from the first pair of first and second lateral support members along the first and second lateral frame members.

16. The transportable garage frame as recited in claim 15, wherein each of i) the first lateral support members and ii) the second lateral support members define respective rigid rectangular side frame with the plurality of first and second lateral frame members respectively.

17. The transportable garage frame as recited in claim 1, further comprising floor panels connected to at least one of the lateral support members and the first and second lateral frame members.

18. The transportable garage frame as recited in claim 17, wherein at least one of the floor panels is connected to said at least one of the lateral support members and the first or second lateral frame members via a pivot joint.

19. The transportable garage frame as recited in claim 17, wherein at least one of the floor panels includes foldable sections.

20. The transportable garage frame as recited in claim 1, wherein at least one of the plurality of frame units includes an actuating system for moving the plurality of frame units between the collapsed and deployed configurations.

21. The transportable garage frame as recited in claim 1, further comprising two traction elements.

22. The transportable garage frame as recited in claim 21, wherein each of the two traction elements being mounted to one of the first and second lateral support members via a lifting mechanism that allows selectively moving the traction element between a lowered and a raised position;

wherein, while the traction elements are in their raised position, the transportable garage lays on the ground, and while the traction elements are in their lowered position, the traction elements allow the transportable garage to be trailed on a road by a suitable vehicle.

23. The transportable garage frame as recited in claim 21, wherein the traction elements are in the form of wheels, skis, blades, or endless track assemblies.

24. The transportable garage frame as recited in claim 21, further comprising a trailer hitch secured to at least one of i) one the plurality of frame units and ii) the first and second lateral support members.

25. A transportable garage comprising:

the transportable garage frame of claim 1; and a covering assembly for covering the transportable garage frame.

26. The transportable garage as recited in claim 25, wherein the covering assembly includes a plurality of covering panels sized and configured to be secured to the frame units so as to extend therebetween, so as to at least partially close the transportable garage frame.

27. The transportable garage as recited in claim 26, wherein a first one of the plurality of frame units being fixedly received near a longitudinal end of the at least one pair of first and second lateral support members; the plurality of covering panels including a pair of garage door panels; each hingedly mounted to a respective one of the first and second lateral frame members of the first one of the plurality of frame units.

28. The transportable garage as recited in claim 27, wherein at least one of the garage door panels being pivotable about a respective first and second lateral frame members of the first one of the plurality of frame units between a first position, wherein the at least one of the garage door panels is generally coplanar with both first and second lateral frame members of the first one of the plurality of frame units, and a second position, wherein the panel is generally parallel a lateral side of the garage.

29. The transportable garage as recited in claim 28, further comprising at least one garage door securing system on the lateral side of the transportable garage frame, for preventing pivotal movements of the at least one garage door panels when the at least one garage door panels is in its second position.

30. The transportable garage as recited in claim 27, wherein the covering assembly further includes a plurality of triangular panels that are mounted to the first one of the plurality of frame units in a fan configuration, above the pair of garage door panels.

31. A method for erecting a transportable garage, the method comprising:

providing a pre-assembled frame assembly comprising first and second support members, and a plurality of frame units connected to the first and second support members therebetween; each frame unit comprising i) an articulated frame member, positioned in a folded configuration and that is configured to be movable in a deployed configuration, and having first and second lateral ends, and ii) first and second lateral frame members that are mounted to the articulated frame member at respective first and second lateral end thereof, and to the first and second support member respectively; and distancing the first and second lateral support members, causing the articulated frame members to be moved in unison in the deployed configuration.

32. The method as recited in claim 31, further comprising covering the pre-assembled frame assembly.

33. The method as recited in claim 32, wherein said covering the pre-assembled frame assembly includes mounting a plurality of panels to the pre-assembled frame assembly, each of the plurality of panels being secured to two adjacent frame units, so as to extend therebetween.

34. A transportable garage comprising:

a plurality of frame units, each including an articulated frame member having first and second lateral ends and being movable between collapsed and deployed configurations; the articulated frame member including first and second lateral V-shaped frame members, each pivotably connected to a respective one of the first and second lateral frame members; at least one of the plurality of frame units including an actuating system for moving the plurality of frame units between the collapsed and deployed configurations; the actuating system including first actuating mechanisms operatively coupled between each of the first and second lateral V-shaped frame members and the respective one of the first and second lateral frame members, and a second actuating mechanism between each two adjacent V-shaped frame members; the first and second actuating mechanisms being operable in unison to move the articulated frame member between the collapsed and deployed configurations;

first and second lateral frame members that are mounted to the articulated frame members at respective first and second lateral ends thereof;

at least one pair of first and second lateral support members for fixedly receiving the plurality of frame units therebetween, respectively by their first and second lateral frame members; and a plurality of covering panels sized and configured to be secured to the plurality of frame units so as to extend therebetween.

* * * * *